US010446301B2

(12) United States Patent
Staavi

(10) Patent No.: US 10,446,301 B2
(45) Date of Patent: Oct. 15, 2019

(54) MIDI CONTROL DEVICE COMBINING TRANSLATORY AND ROTATORY MOVEMENTS

(71) Applicant: RELÉ Musikk AS, Drammen (NO)

(72) Inventor: Bjorn Staavi, Drammen (NO)

(73) Assignee: RELË AS, Drammen (NO)

( * ) Notice: Subject to any disclaimer, the term of this patent is extended or adjusted under 35 U.S.C. 154(b) by 0 days.

(21) Appl. No.: 16/311,702

(22) PCT Filed: Jun. 21, 2017

(86) PCT No.: PCT/EP2017/065221

§ 371 (c)(1),
(2) Date: Dec. 20, 2018

(87) PCT Pub. No.: WO2017/220647

PCT Pub. Date: Dec. 28, 2017

(65) Prior Publication Data

US 2019/0198201 A1 Jun. 27, 2019

(30) Foreign Application Priority Data

Jun. 21, 2016 (NO) ..... 20161033

(51) Int. Cl.
*H01C 10/14* (2006.01)
*G05G 1/02* (2006.01)
(Continued)

(52) U.S. Cl.
CPC ..... *H01C 10/14* (2013.01); *G05G 1/025* (2013.01); *G05G 1/08* (2013.01); *G05G 1/10* (2013.01); *G05G 9/04* (2013.01); *G10H 1/0066* (2013.01); *H01C 10/30* (2013.01); *H01C 10/38* (2013.01); *H04R 5/04* (2013.01); *H04R 3/00* (2013.01); *H04S 1/002* (2013.01); *H04S 3/002* (2013.01)

(58) Field of Classification Search
CPC ..... H01C 10/14; H01C 10/18; G05G 1/10; G05G 9/04; G10H 1/0066
See application file for complete search history.

(56) References Cited

U.S. PATENT DOCUMENTS 4,713,007 A 12/1987 Alban
5,054,361 A * 10/1991 Usa ..... G10H 3/26 84/737

(Continued)

FOREIGN PATENT DOCUMENTS

JP S5615002 U 2/1981

*Primary Examiner* — Kyung S Lee
(74) *Attorney, Agent, or Firm* — Christian D. Abel

(57) ABSTRACT

A manual operating device (100) for providing a first and a second control signal in accordance with a user's operation, e.g. for controlling electronic musical instruments, stage/theatre equipment and/or audio/video studio equipment. The manual operating device (100) comprises a linear position sensor device (110), providing the first control signal (120), representing a linear position of a longitudinally slidable element (130), and a rotary position sensor device (140), having a body attached to the longitudinally slidable element (130) and providing the second control signal (150) representing the rotary position of a rotatable shaft (160) to be manually operated by the user. A MIDI controller device (210) may include at least one such manual operating device (100). Converting the positions parameters to advanced studio equipment MIDI control signals and/or to legacy MIDI synthesizer tone control.

14 Claims, 4 Drawing Sheets

(51) Int. Cl.

| | |
|---|---|
| ***H01C 10/38*** | (2006.01) |
| ***G05G 1/08*** | (2006.01) |
| ***G05G 9/04*** | (2006.01) |
| ***H01C 10/30*** | (2006.01) |
| ***G10H 1/00*** | (2006.01) |
| ***H04R 5/04*** | (2006.01) |
| ***G05G 1/10*** | (2006.01) |
| *H04R 3/00* | (2006.01) |
| *H04S 1/00* | (2006.01) |
| *H04S 3/00* | (2006.01) |

(56) References Cited

U.S. PATENT DOCUMENTS 5,200,568 A 4/1993 Fukushima et al.
5,403,970 A * 4/1995 Aoki ..... G10H 1/055 84/626
5,610,355 A * 3/1997 Hasebe ..... G10H 1/34 84/658
5,805,146 A * 9/1998 Jaeger ..... G02F 1/13306 345/172
6,191,507 B1 * 2/2001 Peltier ..... B65G 54/02 310/12.02
8,339,125 B2 * 12/2012 Arakawa ..... H02K 41/03 324/207.14
8,497,760 B2 7/2013 Whalen et al.
9,148,102 B2 * 9/2015 Wu ..... H03G 3/04
9,866,096 B2 * 1/2018 Preuss ..... H02K 41/025
2003/0188628 A1 10/2003 Caillavet et al.
2007/0193849 A1 * 8/2007 Kato ..... H01C 10/14 192/113.34
2011/0050007 A1 * 3/2011 Kubo ..... H02P 3/24 310/12.19
2011/0252950 A1 10/2011 Trivi
2016/0343497 A1 * 11/2016 Clark ..... H01F 21/065

* cited by examiner

MIDI CONTROL DEVICE COMBINING TRANSLATORY AND ROTATORY MOVEMENTS

TECHNICAL FIELD

The present invention relates to a manual operating device, and in particular a manual operating device for providing a first and a second control signal in accordance with a user's operation.

BACKGROUND

Manual operating devices for providing a first and a second control signal in accordance with a user's operation are used in a large number of human-machine interfaces or operating environments.

In the field of manual control of electronic musical instruments, it may for instance be beneficial for a user, such as a performing musician, to manipulate pitch and volume for an instrument independently and simultaneously, using a one-hand operation. Similarly, in the field of controlling audio/video studio or stage equipment, it may be beneficial for a user, such as a technician, to manipulate volume and stereo pan or balance independently and simultaneously, using a one-hand operation. Many other application areas exist.

U.S. Pat. No. 5,200,568 discloses a method and an arrangement of controlling a sound source for an electronic musical instrument. In particular, the embodiment of FIGS. 8 and 9 in this publication relates to a musical parameter control input device of an electronic musical instrument, which basically is a slide volume type operation member, being slidable in a horizontal direction. The sliding operational member has another operation element which may slide along a groove in another direction than the horizontal sliding direction. The latter operation element may also be rotatable in order to allow a smooth slide operation, and the rotational angle may be detected and used as musical tone control data.

www.doctormix.com/blog/collidoscope relates to a prototype synthesizer that may be played by two performers at the same time. Each performer may operate a sliding knob which allows for the selection, on a display, of a portion of a sample to be played, by moving the knob horizontally. By rotating the knob, the size of the portion being looped may be modified.

U.S. Pat. No. 8,497,760 B2 discloses a system controller device intended for use by persons having limited or no use of their hands. The device includes a first air sensor configured to provide a first electromagnetic signal representative of an air pressure or an air-flow, or a combination thereof, a second orientation sensor configured to provide a second electromagnetic signal representative of a relative orientation or a change of orientation, or a combination thereof, of said first sensor, a third linear position sensor configured to provide a third electromagnetic signal representative of a relative position or change of position, or a combination thereof, of said first sensor along a linear carriage, and a signal processor configured to combine said first, said second and said third electromagnetic signals to provide an event message.

SUMMARY OF THE INVENTION

There is a need for an improved manual operating device for providing a first and a second control signal in accordance with a user's operation.

In particular, there is a need for providing such a manual operating device which is easy to use, accurate in operation, robust and reliable, and/or cheap and simple to manufacture.

The invention provides a manual operating device for providing a first and a second control signal as set forth in the appended, independent claim 1.

Advantageous embodiments and features have been set forth in the dependent claims.

The invention will be described in closer detail by means of non-limiting examples with reference to the drawings.

DETAILED DESCRIPTION OF THE INVENTION

Figure 1:
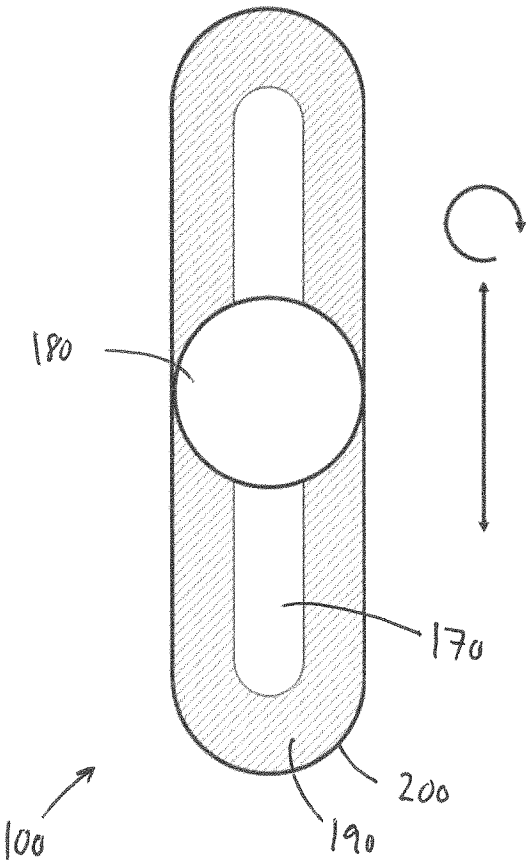
FIG. 1 is a schematic diagram illustrating principles of the manual operating device.

FIG. 1 is a schematic diagram illustrating principles of the manual operating device 100.

FIG. 1 is a schematic top view of the manual operating device 100 as seen from a user's point of view. The manual operating device 100 is configured to provide a first and a second control signal in accordance with a user's manual operation. More particularly, a knob 180, which may be substantially cylindrical, is intended to be operated by the user. The knob 180 may be rotated by the user about an axis that coincides with the axis of the cylindrical shape of the knob 180. Also the knob 180 may be moved in a linear manner along a longitudinal slit 170. The rotational and linear movements of the knob may be performed simultaneously or during discrete periods of time. The linear movement of the knob 180, along the longitudinal slit 170, results in a first control signal provided by the manual operating device 100, while rotational movement of the knob 180 results in a second control signal provided by the manual operating device 100.

The longitudinal slit 170 is provided as a linear opening in a top cover, and a rotational shaft to which the knob 180 is attached, is passed through the slit 170. As further shown in FIG. 1, the top cover may have a recessed, oval surface area 190 which surrounds the longitudinal slit 170 and designed in such a way that a perimeter 200 of the oval surface area 190 provides an abutting edge for the knob 180 throughout the knob's allowed range of rotary and linear movement.

Figure 2B:
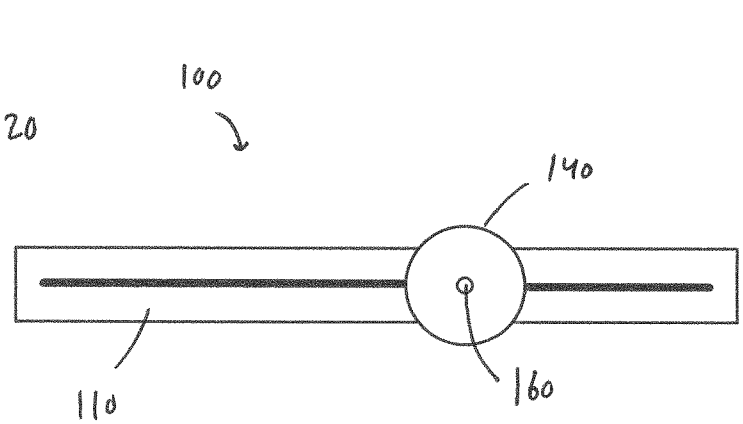
FIG. 2B is a schematic top view of the manual operating device shown in FIG. 2A.
Figure 2A:
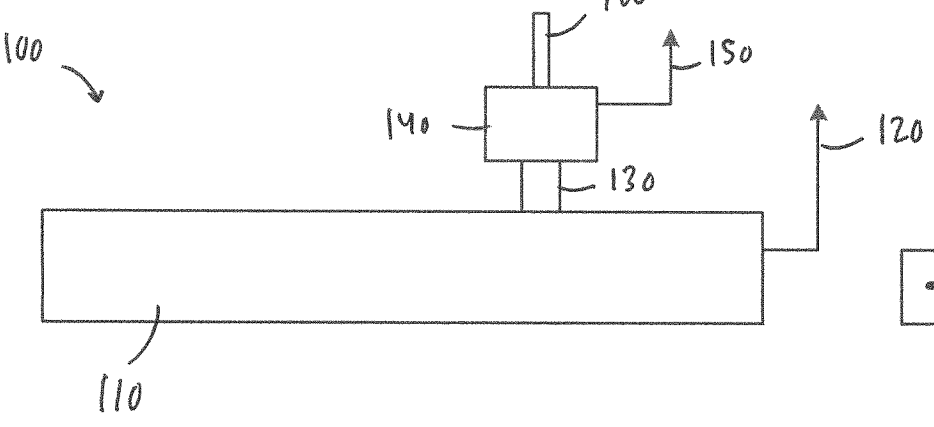
FIG. 2A is a schematic side view illustrating further principles and elements of the manual operating device.

FIG. 2A is a schematic side view illustrating further principles and elements of the manual operating device, and FIG. 2B is a schematic top view of the manual operating device shown in FIG. 2A.

As already mentioned with reference to FIG. 1, the manual operating device 100 is configured to provide a first and a second control signal in accordance with a user's operation. To this end, the manual operating device 100 comprises a linear position sensor device 110 which provides the first control signal 120. The first control signal 120 represents a linear position of a linearly slidable element 130.

The manual operating device 100 further comprises a rotary position sensor device 140, having a body which is attached to the linearly slidable element 130 of the linear position sensor device 110. The rotary position sensor device 140 provides the second control signal 150, which represents the rotary position of a rotatable shaft 160 which is arranged to be manually operated by the user. More specifically, to facilitate the user's manual operation, a knob 180 (not shown in FIG. 2A or 2B), such as a substantially cylindrical knob, is attached to the rotatable shaft 160.

Figure 3:
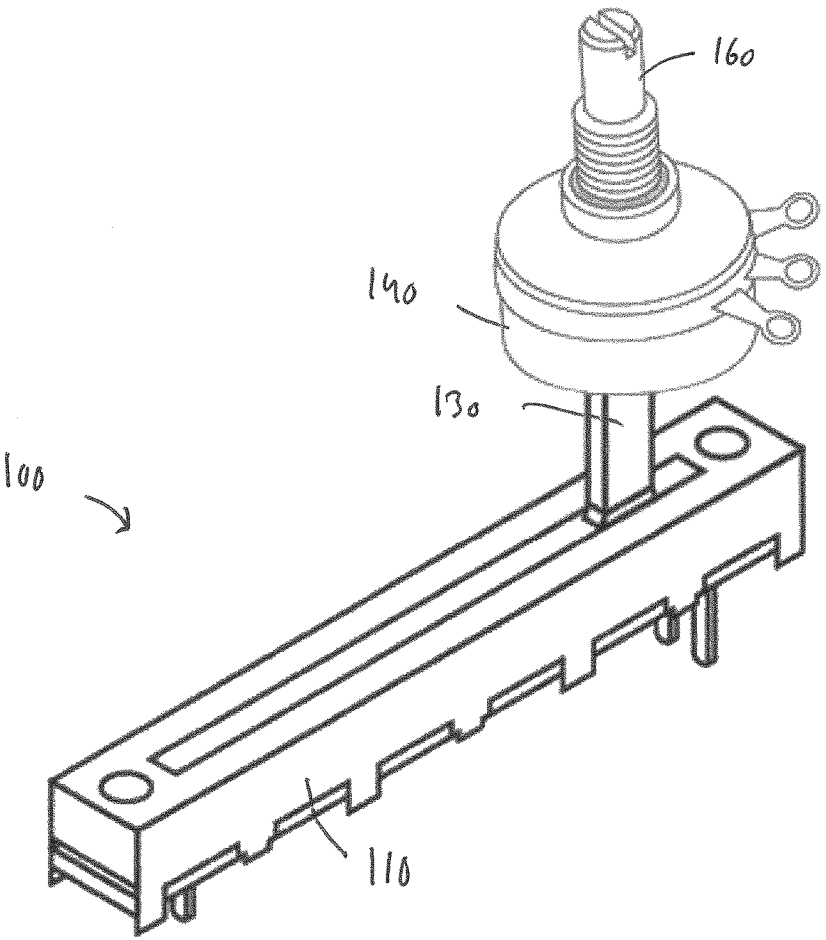
FIG. 3 is a schematic diagram illustrating principles of an embodiment of the manual operating device.

FIG. 3 is a schematic diagram illustrating principles of an embodiment of the manual operating device. More specifically, FIG. 3 is a perspective view that illustrates further principles of the manual operating device which has also been illustrated in FIGS. 2A and 2B.

In the embodiment of FIG. 3, the linear position sensor device 110 is a slide potentiometer. Other types of resistive linear position sensor devices are also possible.

The slide potentiometer includes a straight electrical resistance element, for instance containing a resistive polymer. The slide potentiometer may be connected as a voltage divider. In this case a fixed DC potential is applied across the resistance element, and a sliding wiper senses a voltage between one of the ends of the resistance element and the wiper. The first control signal 120 may in this case be represented by the voltage of the wiper.

In other embodiments, the linear position sensor device 110 may be an optical, magnetic, magnetoresistive, magnetostrictive or inductive linear position sensor device. For instance, the linear position sensor device 110 may be a magnetic linear encoder. Such a magnetic linear encoder may be equipped with one or more Hall effect sensor. Alternatively, the linear position sensor device may be an optical linear encoder with an optical grating and one or more photodiodes or phototransistors.

In the case of a slide potentiometer as the linear position sensor device 110, the first control signal 120 is an analog signal. In other cases the first control signal 120 may be analog or digital. If the first control signal is analog, it may be digitized by means of an analog-digital converter.

The linear position sensor device 110 may in some additional aspects also be capable of sensing other variables such as speed of sliding.

Further, in the embodiment of FIG. 3, the rotary position sensor device 140 is a rotary potentiometer. Other types of resistive rotary position sensor devices are also possible.

The rotary potentiometer includes a curved electrical resistance element, for instance containing a resistive polymer. The rotary potentiometer may be connected as a voltage divider. In this case a fixed DC potential is applied across the curved resistance element, and a rotatable wiper senses a voltage between one of the ends of the resistance element and the wiper. The first control signal 120 may in this case be represented by the voltage of the wiper.

In other embodiments, the rotary position sensor device 140 may be an optical, magnetic, magnetoresistive, magnetostrictive or inductive rotary position sensor device. For instance, the rotary position sensor device 140 may be a magnetic rotary encoder. Such a magnetic rotary encoder may be equipped with one or more Hall effect sensors. Alternatively, the rotary encoder may be an optical rotary encoder with an optical grating and one or more photodiodes or phototransistors.

The rotary position sensor device 140 may advantageously have an angular range of less than 360 degrees, for instance in the sub-range 240 degrees to 330 degrees, or more specifically in the sub-range 270 degrees to 300 degrees. However, the rotary position sensor may also be of a type having more than one turn, i.e., with an angular range of more than 360 degrees, such as 720 degrees (2 turns), 1080 degrees (3 turns) or more. An angular range of less than 240 degrees is also possible.

The rotary position sensor device 140 may in some additional aspects also be capable of sensing other variables such as angular orientation, rotation direction, number of turns, and/or speed of rotation.

Hence, the manual operating device 100 according to the embodiment of FIG. 3 comprises a slide potentiometer 110 which provides the first control signal 120. The first control signal 120 represents a linear position of the slide potentiometer 110. Further, the manual operating device 100 according to the embodiment of FIG. 3 comprises a rotary potentiometer 140, having a body which is attached to the linearly slidable element 130 of the slide potentiometer 110. The rotary potentiometer 140 provides the second control signal 150, which represents the rotary position of a rotatable shaft 160 which is arranged to be manually operated by the user.

The slide potentiometer 110 includes, on its underside, connectors, typically three connectors, that may be led through openings in a printed circuit board and soldered to conductive paths on the printed circuit board. Similar connections may be provided in the case of other types of linear position sensors, such as the alternatives referred to above. Other connection means are also possible. The rotary potentiometer 140 also includes connectors, typically three connectors, that may be connected to appropriate electronic circuitry e.g. by means of wires, which allow for linear movement of the potentiometer 140. Similar connections may be provided in the case of other types of rotary position sensors, such as the alternatives referred to above.

Figure 4:
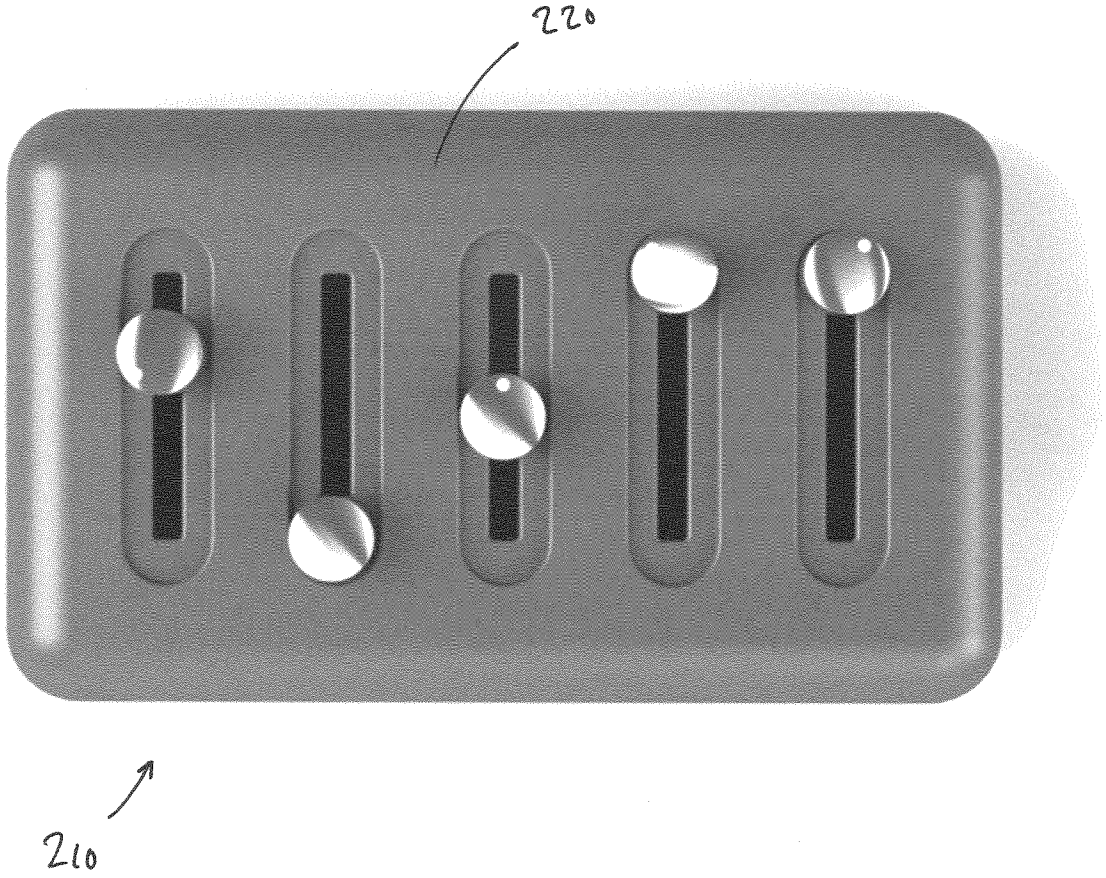
FIG. 4 is a top view illustrating a MIDI controller device which includes a plurality of manual operating devices.

FIG. 4 is a top view illustrating a MIDI controller device 210 which includes a plurality of manual operating devices.

The MIDI (Musical Instrument Digital Interface) controller device 210 includes a processing device (not shown) with a plurality of signal inputs connected to respective signal outputs of the plurality of manual operating devices. The processing device is configured, using appropriate software included in a memory and connected to the processing device, to convert the signals provided by the manual operating devices into MIDI control messages to be transferred over a MIDI interface. To this end, the MIDI control messages are provided to a MIDI output of the MIDI controller device 210. One or more external MIDI enabled device, such as musical instruments, stage/theatre equipment and/or audio/video studio equipment, may be connected to the output of the MIDI controller device 210, enabling the MIDI controller device 210 to control the musical instruments, stage/theatre equipment and/or audio/video studio equipment.

As already mentioned with reference to FIG. 1, the manual operating device 100 may include a top cover 220. Such a top cover 220 has been illustrated in FIG. 4. In this case a single top cover 220 is used for a plurality manual operating devices 100 that are arranged within one single device, more particularly a MIDI controller device 210. Specifically, in the example shown in FIG. 4, five manual operating devices 100 are arranged within the MIDI controller device 210. It should be understood that any number of manual operating devices 100, including 1, 2, 3, 4, 5 and more than 5, may readily be arranged within the MIDI controller device 210.

FIG. 4 also shows that the top cover 220, for each of the manual operating devices 100, further has a recessed, oval surface area 190 surrounding the longitudinal slit 170, in such a way that a perimeter 200 of the oval surface area 190 provides an abutting edge for the knob 180 throughout the knob's allowed range of rotary and linear movement. This provides for a stabilizing support arrangement for the manual operating devices 100.

As an additional improvement, the manual operating device 100 may also include a stabilizing rail (not shown), arranged beneath the top cover 220, which provides lateral support of a movement of the linearly slidable element 130, or of the body of the rotary position sensor device 140, or of the rotatable shaft 160. In the MIDI controller device embodiment of FIG. 4, five such stabilizing rails would appropriately be arranged.

In any one of the illustrated and described embodiments of the manual operating device 100, the manual operating device may further comprise electronic circuitry for adapting the first and second control signals to secondary control signals for controlling electronic musical instruments, stage/theatre equipment and/or audio/video studio equipment. In a particularly advantageous example, the electronic circuitry may be configured to provide the secondary control signals as digital data in accordance with the MIDI protocol.

Although the manual operating device has been particularly described as being useful for controlling electronic musical instruments, stage/theatre equipment and/or audio/video studio equipment, numerous other application areas exist. For instance, the manual operating device may advantageously be used for controlling medical equipment, e.g. medical imaging or diagnostic devices (e.g., controlling ultrasonic imaging equipment), for remote control of surgical devices, etc. The manual operating device may also advantageously be used in controlling industrial processes, vehicle equipment (in cars, construction machines, vessels, submarines, etc.)

The invention has been described above with reference to some advantageous exemplary embodiments. It should be understood that the scope of the invention is not limited to the detailed examples presented herein. Instead, the scope of the invention has been defined by the appended claims.

The invention claimed is:

1. A manual operating device (100) for providing a first and a second control signal in accordance with a user's operation, the manual operating device (100) comprising a linear position sensor device (110), providing the first control signal (120), representing a linear position of a linearly slidable element (130), a rotary position sensor device (140), having a body attached to the linearly slidable element (130) and providing the second control signal (150) representing the rotary position of a rotatable shaft (160) to be manually operated by the user, and further comprising a top cover (220), the top cover having a longitudinal slit (170), the rotatable shaft (160) being passed through the longitudinal slit (170), the rotatable shaft (160) being attached to a knob (180) to be manually operated by the user, the top cover (220) further having a recessed, oval surface area (190) surrounding the longitudinal slit (170), in such a way that a perimeter (200) of the oval surface area (190) provides an abutting edge for the knob (180) throughout the knob's allowed range of rotary and linear movement.

2. A manual operating device (100) according to claim 1, wherein the linear position sensor device (110) is a slide potentiometer.

3. A manual operating device (100) according to claim 1, wherein the linear position sensor device (110) is an optical, magnetic or inductive linear position sensor device.

4. A manual operating device (100) according to claim 1, wherein the rotary position sensor device (140) is a rotary potentiometer.

5. A manual operating device (100) according to claim 1, wherein the rotary position sensor device (140) is an optical, magnetic or inductive rotary position sensor device.

6. A manual operating device (100) according to claim 1, further comprising electronic circuitry for adapting the first and second control signals to secondary control signals for controlling electronic musical instruments, stage/theatre equipment and/or audio/video studio equipment.

7. A manual operating device (100) according to claim 6, wherein the electronic circuitry is configured to provide the secondary control signals as digital data in accordance with the Musical Instrument Digital Interface protocol, MIDI.

8. A manual operating device (100) according to claim 1, further comprising a stabilizing rail, arranged beneath the top cover (220), providing lateral support of a movement of the linearly slidable element (130), or the body of the rotary position sensor device (140), or the rotatable shaft (160).

9. A MIDI controller device (210), comprising at least one manual operating device as set forth in claim 1.

10. A MIDI controller device (210), according to claim 9, wherein the at least one manual operating device includes a plurality of manual operating devices.

11. A MIDI controller device (210) according to claim 10, including a processing device with a plurality of signal inputs connected to respective signal outputs of the plurality of manual operating devices.

12. A MIDI controller device (210) according to claim 11, wherein the processing device is configured, using appropriate software included in a memory and connected to the processing device, to convert the signals provided by the manual operating devices into MIDI control messages to be transferred over a MIDI interface.

13. A MIDI controller device (210) according to claim 12, wherein the MIDI control messages are provided to a MIDI output of the MIDI controller device 210.

14. A MIDI controller device (210) according to claim 13, further comprising one or more external MIDI enabled devices, such as musical instruments, stage/theatre equipment and/or audio/video studio equipment, connected to the output of the MIDI controller device 210, enabling the MIDI controller device 210 to control the MIDI enabled device.

* * * * *